United States Patent [19]

Prichard et al.

[11] 4,284,874

[45] Aug. 18, 1981

[54] CLAMP TYPE HEATER FOR BACK-PART MOLDING SHOE MACHINES

[75] Inventors: Arthur W. Prichard; Francis B. Sharp, both of Leicester, England

[73] Assignee: USM Corporation, Farmington, Conn.

[21] Appl. No.: 75,905

[22] Filed: Sep. 17, 1979

[30] Foreign Application Priority Data

Oct. 5, 1978 [GB] United Kingdom ..... 39373/78

[51] Int. Cl.[3] ..... A43D 25/20; H05B 1/02

[52] U.S. Cl. ..... 219/215; 219/251; 219/358; 219/509

[58] Field of Search ..... 219/215, 509, 358, 250–253, 219/256, 257, 243, 411; 12/145, 146 C; 156/320, 583.1, 583.2, 583.3, 583.7

[56] References Cited

U.S. PATENT DOCUMENTS

| | | | |
|---|---|---|---|
| 2,694,131 | 11/1954 | Carson | 219/215 |
| 3,517,160 | 6/1970 | Maga | 219/215 |
| 4,140,894 | 2/1979 | Katakura et al. | 219/358 |

FOREIGN PATENT DOCUMENTS 1186875 4/1970 United Kingdom .

*Primary Examiner*—Arthur T. Grimley
*Assistant Examiner*—Bernard Roskoski
*Attorney, Agent, or Firm*—Donald N. Halgren

[57] ABSTRACT

A clamp heater for heating shoe upper portions prior to molding them comprises an inner metal form and a cooperating outer band constructed of silicone rubber. The inner metal form has a cartridge heater accommodated therein. The outer band is heated by a radiant heater arranged about its outer surface. When the inner form carries a shoe upper portion into the outer band, the outer band wraps around the shoe upper portion and clamps it about the inner form, to ensure efficient heat transfer. To protect the outer band from heat damage, a temperature control device in the form of a thermostat is provided. The inner form also has a temperature control device therein. To ensure adequate heat is available in the operation of the clamp, when the inner form is moved to carry the shoe upper portion into the outer band, the temperature controls are both overridden and the heaters are rendered operative.

11 Claims, 2 Drawing Figures

Simmerstat
22
50
50
L
N
66
Thermo-
stat
38
64
52
62
20 Cartridge
Heater
Radiant
Heater
36
56
TM1
54
TM
58
SOL
60
RL1

CLAMP TYPE HEATER FOR BACK-PART MOLDING SHOE MACHINES

BACKGROUND OF THE INVENTION

1. Field of the Invention

This invention is related to shoe machines and more particularly to heating devices for heating portions of shoe uppers prior to molding such portions.

2. Prior Art

Devices for heating and molding portions for shoe uppers generally comprise an inner form and a cooperating outer band, with motive means for effecting relative movement between the inner form and the outer band, where a shoe upper placed therebetween may be clamped therebetween. Heating and molding devices may also include a first heating means for heating the inner form and a second heating means for heating the outer band, the second heating means comprising a radiant heater arrangement to which the outer surface of the outer band is exposed. Such a device may be found in the U.K. Patent Specification Number 1,186,875. A commercial embodiment of the above described device utilizes a radiant heater means by which the outer band is heated and controlled by a simmerstat, that is, by heater means which is switched on and off on a timed basis. In order to protect the outer band from over heating, and consequent degradadation, the heater timer means has to be set so that the outer band can not be heated above the degradadation temperature of the material of the outer band.

When the heater device is in use, however, heat is drained quickly from the outer band when it brought into a clamping engagement with a relatively cold shoe upper portion. When the device is in use, heat is drained quickly from the outer band when it is brought into clamping engagement with a relatively cold shoe upper portion. If such contact takes place during the time when the heater switching means has switched the heater means off, no heat in the outer band is replaced, with a result that insufficient heat is supplied into the shoe upper portion from the outside. It is desireable, especially for actuating thermoplastic stiffeners, or stiffeners coated with a thermoplastic material, that the heat be applied through the whole thickness of the thermoplastic material. It has been necessary in the heating device being described, to rely to a larger extent upon the supply of heat from the inner form. In order to heat through the thickness of the thermoplastic material, however, by heat largely supplied from the inside the shoe upper portion, excessive heat may be applied, which can lead to damage to the lining of the shoe upper portion. If, on the other hand, precautions are taken to avoid damage to the lining of the shoe upper, then it may be that insufficient heat is applied from the linear rather from the inner form.

It is an object of the present invention to provide an improved heater device in which a suitable balance of heat can be supplied from the inside form as well as from the outside form to a shoe upper portion therebetween.

BRIEF SUMMARY OF THE INVENTION

The present invention comprises a heater device for heating portions of shoe uppers prior to molding such portions to a desired shape. The heater device comprises an inner form and a cooperating outer band, including motor means for effecting relative movement between the inner form and the outer band whereby a shoe upper portion placed therebetween can be clamped therebetween. The heating device also comprises a first heating means for heating the inner form and a second heating means for heating the outer band, the second heating means comprising a radiant heater to which the outer surface of the outer band is exposed. The second heating means is connected to a first circuit which incorporates thermostatic control means for limiting the temperature to which the outer band is heated by the second heating means. A second circuit which also incorporates a switch which is operated when the motor means is actuated, is arranged so that the temperature to which the outer band is heated is controlled by the thermostatic control means when the heating device is in a rest condition, but the second heating means is rendered operative regardless of the thermostatic control means, when the device is being used.

The second heating means is always rendered operative to replace the heat being drained from the outer band by the relatively cold shoe upper portion which is in clamping engagement therewith. Because a thermostatic control arrangement is used, which is responsive to changes in temperature in the outer band or in the atmosphere surrounding the outer band, the outer band can always be maintained at or near its optimum operating temperature, without the risk of it being overheated, even when the heater is switched on for long periods of time without being used.

BRIEF DESCRIPTION OF THE DRAWINGS

The objects and inventions of the present invention will become more apparent when viewed in conjunction with the following drawings in which.

DESCRIPTION OF A PREFERRED EMBODIMENT

Figure 1:
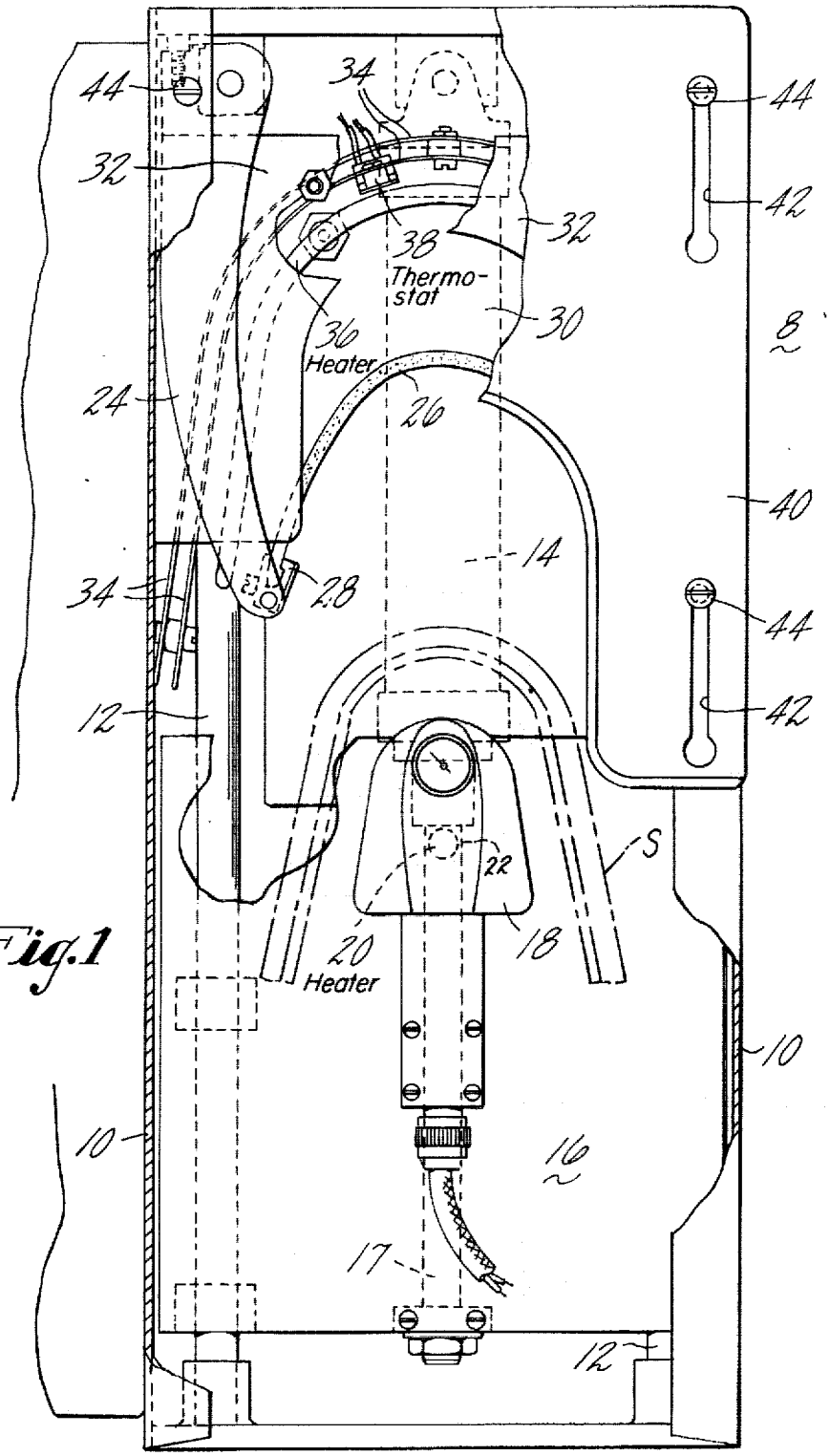
FIG. 1 is a front view with parts broken away, of a shoe upper heating and molding machine constructed according to the principles of the present invention.

Referring now to the drawings in detail, and particularly to FIG. 1, there is shown a shoe upper backpart heating and molding device 8, which comprises part of an overall shoe molding machine, not shown, wherein backpart portions of shoe uppers are heated prior to the backpart moulding of such uppers. The heat molding device 8, comprises a frame 10, which supports a pair of vertical slide rods 12, as well as a piston and cylinder arrangement 14, which is centrally disposed therebetween. A plate 16 is secured at its lower end to the lower end of a piston rod 17 which is part of the piston and cylinder arrangement 14. The plate 16 is slideable on the vertical slide rods 12. An inner form 18 is carried on the plate 16. The inner form 18 is provided with a cartridge heater 20 adapted therewith. The cartridge heater 20 also includes a simmerstat 22 which switches the heater on and off on a timed basis. The inner form 18 may have a shape which is generally similar to the heel portion of a last.

Several sets of depending arms 24, only one shown in FIG. 1, are supported on the frame 10. Each set of depending arms 24 comprises a forward and a rearward arm. An outer band 26 is carried by the two sets of arms 24, the ends of the band 26 being supported in an arrangement of mountings 28. Each mounting 28 is supported in turn between a forward and a rearward arm 24 of each set. The outer band 26 is comprised of silicone rubber capable of withstanding temperatures in the order of about 225° C. The inwardly facing surface of each mounting 28 is provided with a smooth resilient low friction surface, to prevent the mounting 28 from marking a shoe upper portion, partially shown here by phantom lines designated "S".

A chamber is defined in said device by back plate 30 secured to the frame 10, a front plate 32 also secured to the frame 10, and a cover extending therebetween. The cover is generally in the shape of an inverted U and comprises two closely spaced apart shaped wall members 34 providing a double-skin effect. The outer band 26 extends upwardly through the bottom of said chamber. The front plate 32 and the inner of the two wall members 34 are made of polished stainless steel. The back plate is made of aluminum, to provide reflective surfaces for the chamber. A radiant heater element 36, is mounted within the chamber and is shaped generally to the shape of the cover, for example in the shape of an inverted U. The heater element 36 is generally referred to as a back heater. The heater element 36 is mounted on the back plate 30, and serves to heat the air in the chamber to provide an oven arrangement.

A thermostatic control means comprising a temperature sensative element 38 is supported in the inner one of the plates 34 at or near the apex of the cover and close to the heater element 36 in order to sense change in the temperature of the air in the chamber. By varying the position of the temperature sensative element 38 in relation to the position of the heater element 36, the time taken for the air in the chamber adjacent the temperature sensative element 38 to heat to a temperature at which the temperature sensative element 38 is operated can be varied. Thus the overall air temperature in the chamber as well as the amount of heat thus applied to the outer band 26 can be varied as well.

Figure 2:
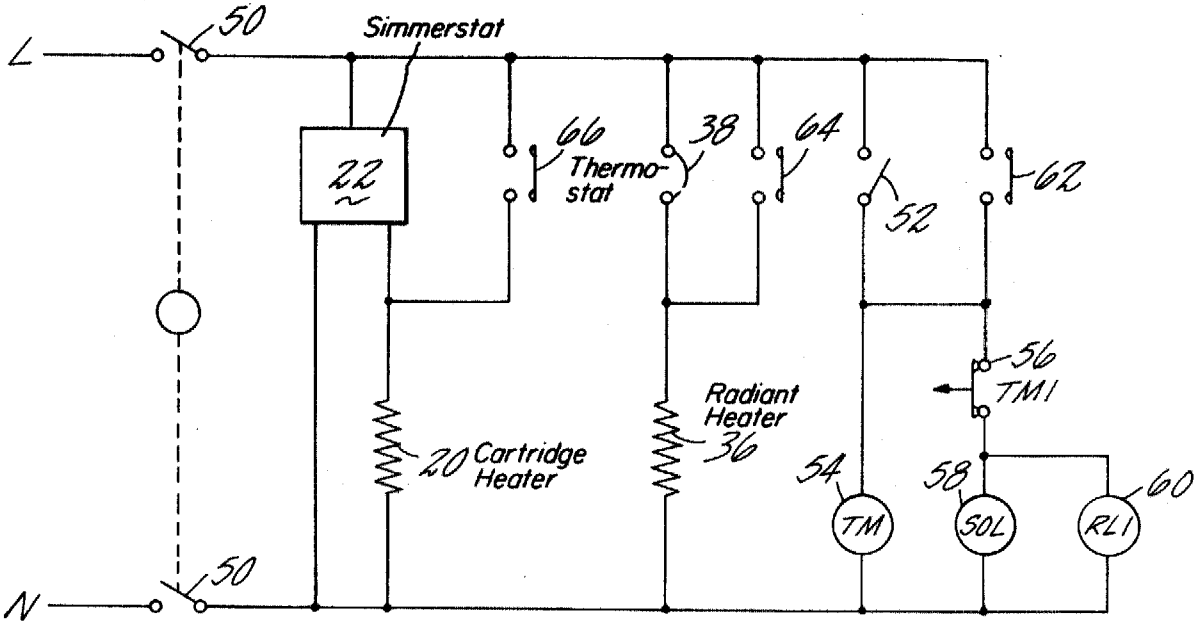
FIG. 2 is a diagram of an electrical control circuit for the present invention.

A circuit is shown in FIG. 2, for actuating the heating and moulding device 8. The circuit receives electrical power through lines L and N. An illuminated rocker switch 50, disposed across the incoming lines L and N comprises the main off-on switch. When the rocker switch 50 is closed, a foot switch 52 may be closed to initiate operation of a timer 54. The timer 54 includes an arrangement of contacts 56, which when closed, operates a solenoid 58 to allow air under pressure through a proper system, not shown, to be admitted to the piston and cylinder arrangement 14, to move the inner form 18 upwardly into a mating relationship with the outer band 26, as well as operates to energize a relay 60. The relay 60, has a pair of contacts 62, which when energized, close, creating a holding circuit with the timer 54, the solenoid 58, the relay 60 and a second set of contacts 64 which close thereby, overriding the thermostat control 38 of the radiant heater element 36. Also, a third set of contacts 66 close, overriding the simmerstat control 22 for the cartridge heater 20.

The radiant heater element 36 and the cartridge heater 20 are each supplied by a first circuit incorporating temperature control means such as the thermostat control 38 and the simmerstat 22, respectively, and by a second circuit incorporating the second and third relay contacts, 64 and 66, respectively, the arrangement being such that when the solenoid 58, and thus the piston and cylinder arrangement 14, are actuated to move the inner form 18 upwardly and carry a shoe upper backpart portion placed thereon into clamping engagement with the outer band 26, the temperature to which said outer band 26 and also the inner form 18 are heated ceases to be controlled by the thermostat control 38 and the simmerstat 22, respectively, as occurs when the device is in a rest condition, but rather the radiant heater element 36 and the cartridge heater 20 are both rendered operative, regardless of their associated temperature control means. In this way, adequate heat is supplied to shoe upper backpart portions via both the inner form 18 and the outer band 20, when the backpart heating and molding device 8 is in operation.

When the timer 54 times out, the contacts 56 are opened, thereby de-energising the solenoid 58 and the relay 60, the contacts 62 of which are then caused to open. In this way, the inner form 18 is returned to its lower position, and the thermostat control 38 and the simmerstat 22 once more serve to control the operation of the radiant heater element 30 and the cartridge heater 20, respectively.

A front guard member 40 is shown in FIG. 1, having a cut-away portion in its lower edge. The cut-away portion is in the shape of an inverted U, and is mounted on the frame 10 for heightwise sliding movement thereon. An arrangement of slots 42 are provided in the front guard 40 which is held on a set of headed bolts 44 accommodated in the slots 42. The sliding movement is arranged to enable the front guard member 40 to be raised to prevent the risk of the operator's hand being trapped thereagainst when the inner form 18 is raised. Each slot 42 has a larger opening at its lower end, to allow its associated bolt 44 to pass therethrough permitting access to the radiant heater element 36, therebetween.

Thus, there has been shown a shoe upper heating and molding apparatus having a flexible outer band which is heated by a thermostatically controlled oven arrangement to provide an improved balance of heat supplied to a shoe upper being heated and molded thereby.

It is intended that the appended claims be interpeted as exemplary only, and not in a limiting sense.

We claim:

1. A heater device for heating portions of show uppers prior to molding such portions to a desired shape, the device comprising:

an inner form and a cooperating outer band;

a motor means for effecting relative movement between said inner form and said outer band whereby a shoe upper portion placed therebetween can be clamped therebetween;

a first heating means for heating said inner form and a second heating means for heating said outer band, said second heating means comprising radiant heater means to which the outer surface of the band is exposed, wherein said second heating means is connected to a first circuit, which also incorporates thermostatic control means for limiting the temperature to which said outer band is heated by said second heating means and further to a second circuit, which also incorporates a switch which is operated when the motor means is actuated, the heating device being such that the temperature to which said outer band is heated is controlled by said thermostatic control means when the device is in a rest condition, but said second heating means is rendered operative by said switch when said motor means is activated, regardless of said thermostatic control means; and wherein said second heating means is accommodated in a chamber which is open at the bottom, through which said band extends thereinto, and further wherein said theremostatic control means is responsive to change in the temperature of the air in the chamber.

2. A heater device for heating portions of shoe uppers as recited in claim 1 wherein the chamber is formed from front and rear wall members and has a cover extending therebetween, the cover, which is generally in the shape of an inverted U, is arranged closely adjacent said radiant heater means.

3. A heater device for heating portions of shoe uppers as recited in claim 2 wherein said cover comprises two closely spaced apart shaped wall members.

4. A heater device for heating portions of shoe uppers as recited in claim 2 wherein said thermostatic control means comprises a temperature-sensitive element supported in said cover near the apex of the inverted U in said cover.

5. A heater device for heating portions of shoe uppers as recited in claim 4 wherein said temperature sensitive element is supported in the cover to permit adjusting movement thereof towards and away from said radiant heater means.

6. A heater device for heating portions of shoe uppers as recited in claim 5 wherein said wall members have reflective surfaces for reflecting radiant heat into the chamber.

7. A heater device for heating portions of shoe uppers as recited in claim 5 wherein the outer band is of a resilient material capable of withstanding temperatures in the order of about 225° C.

8. A heater device for heating portions of shoe uppers as recited in claim 7 wherein said outer band is comprised of a silicone rubber.

9. A heater device for heating portions of shoe uppers as recited in claim 7 wherein said outer band, which is generally in the form of an inverted U, is supported at its ends by freely pivotable arms so that, when relative movement is effected between said inner form and said outer band, said outer band is first engaged at the apex of its inverted U and is thereafter stretched upwardly, thereby causing the arms to pivot inwardly, said outer band thereby being caused to wrap around said inner form.

10. A heater device for heating portions of shoe uppers as recited in claim 9 wherein said motor means comprises a pneumatic motor for moving said inner form heightwise relative to said outer band.

11. A heater device for heating portions of shoe uppers as recited in claim 9 wherein said inner form is made of metal, and wherein said first heating means comprises a cartridge heater accommodated in said inner form, said first heating means being connected to a first circuit, which also incorporates temperature control means, and further to a second circuit, which incorporates a switch which is operated when said motor means is actuated, the arrangement being such that the temperature to which said inner form is heated is controlled by said temperature control means when the device is in a rest condition, but the first heating means is rendered operative, regardless of said control means, when the device is being used.

* * * * *